US007137178B1

(12) United States Patent
Daume et al.

(10) Patent No.: US 7,137,178 B1
(45) Date of Patent: Nov. 21, 2006

(54) PROTECTIVE DEVICE FOR VEHICLE SEAT BELT LATCH RELEASE

(75) Inventors: Eric Daume, Dublin, OH (US); Hidetsugu Okazaki, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/225,454

(22) Filed: Sep. 13, 2005

(51) Int. Cl.
*A44B 21/00* (2006.01)

(52) U.S. Cl. ..... 24/633; 200/43.18; 200/43.14; 200/43.21; 200/43.16

(58) Field of Classification Search ..... 24/633, 24/579.11, 487, 265 R; 200/43.14, 43.18, 200/43.22

See application file for complete search history.

(56) References Cited

U.S. PATENT DOCUMENTS

| | | | | |
|---|---|---|---|---|
| 3,484,908 | A | 12/1969 | Lamb | |
| 3,678,236 | A * | 7/1972 | Hughes | 200/43.18 |
| 4,402,114 | A | 9/1983 | Takagi | |
| 4,731,912 | A | 3/1988 | Boriskie et al. | |
| 4,885,456 | A * | 12/1989 | Tanaka et al. | 219/497 |
| 4,955,115 | A * | 9/1990 | Tanaka | 24/641 |
| 4,978,816 | A * | 12/1990 | Castonguay et al. | 200/43.14 |
| 4,987,662 | A | 1/1991 | Haffey et al. | |
| 5,129,129 | A | 7/1992 | Collins et al. | |
| 5,290,979 | A * | 3/1994 | Grass | 200/43.19 |
| 5,307,544 | A | 5/1994 | Quarberg et al. | |
| 5,416,957 | A | 5/1995 | Renzi, Sr. et al. | |
| 5,907,140 | A * | 5/1999 | Smith | 200/43.19 |
| 6,041,480 | A | 3/2000 | White | |
| 6,365,851 | B1 * | 4/2002 | Gasper | 200/43.14 |
| 6,539,595 | B1 | 4/2003 | Benedict | |
| 6,647,750 | B1 * | 11/2003 | Kaneko et al. | 70/58 |
| 6,769,157 | B1 | 8/2004 | Meal | |
| 2003/0079321 | A1 | 5/2003 | Dean, III et al. | |
| 2004/0255438 | A1 | 12/2004 | Benedict | |
| 2004/0255439 | A1 | 12/2004 | Benedict | |

* cited by examiner

*Primary Examiner*—Robert J. Sandy
*Assistant Examiner*—Marcus Menezes
(74) *Attorney, Agent, or Firm*—Christen Millard; Michael A. Forhan; Eley Law Firm Co.

(57) ABSTRACT

A protective device for a latch release actuator of a vehicle seat belt. The protective device comprises a shield having an aperture. The shield is attachable to a latch body such that the shield substantially surrounds the latch release actuator and the aperture is situated proximate the latch release actuator so as to deter unintended actuation of the latch release actuator.

16 Claims, 7 Drawing Sheets

PROTECTIVE DEVICE FOR VEHICLE SEAT BELT LATCH RELEASE

FIELD

The present invention relates generally to vehicle seat belts. In particular, the present invention relates to a device installed proximate a seat belt latch release mechanism to deter unintentional release of a seat belt latch.

BACKGROUND

Body restraint systems including seat belts, lap belts, shoulder harnesses and the like have been credited with preventing injuries and saving numerous lives in vehicular accidents. The positive benefits obtained due to body restraints has been so recognized that, in the United States, the use of seat belts is mandated in all states.

Most conventional vehicle body restraint systems incorporate a belt that crosses in front of the lap and diagonally across the body of the vehicle operator or passenger. The belts are retained by latching mechanisms located within belt buckles wherein lock plates located at ends of the belts are inserted into the buckles to engage the latching mechanism. The buckles are in turn normally anchored to the vehicle frame.

Conventional seat belt systems generally utilize two types of latch release mechanisms to allow lock plates to be removed from buckle housings such that restrained occupants can exit the vehicle. A first type of latch release system includes a release button that is generally resiliently biased outwardly at an angle perpendicular to an axis or line of insertion of the lock plate into a buckle housing. To release the seat belt the occupant depresses the button with a force sufficient to overcome the bias. The button engages an actuator for the release mechanism, causing the release mechanism to operate and accordingly allows the lock plate to separate from the buckle. A second type of latch release system is an end release system and includes a lever or button for releasing the lock plate from the buckle housing. In the first instance the button is resiliently biased outwardly generally parallel to the line of insertion of the lock plate into the buckle housing. In the second instance the lever is pivotally mounted at an end of the buckle housing and biased such that the lever is held generally parallel to the lock plate. An occupant overcomes the bias to separate the belt from the buckle by depressing the button or pivoting the lever to engage the actuator and operate the latch release mechanism.

Latching mechanisms for vehicle body restraint systems are subject to unintentional release under certain conditions such as an accident, collision or rollover whereby a foreign object forcibly engages the latch release mechanism, compromising the effectiveness of the restraint system. Current seat belt latching mechanisms may include a simple bent tab to protect the latch release from intrusion by foreign objects. However, it is possible under certain conditions for a foreign object to avoid the tab and engage the latch release. In view of the foregoing, there remains a need to further improve upon the reliability and effectiveness of body restraint safety belt systems in vehicles to reduce the likelihood of unintentional release of latching mechanisms associated therewith by foreign objects during vehicle accidents, collisions and rollovers.

SUMMARY

The disclosed invention is a shield attached to a seat belt latch, proximate an actuator for a latch release mechanism. The shield surrounds and protects the actuator, thereby limiting operation of the actuator to forces directed generally perpendicular to the actuator. Accordingly, the shield is effective to resist unintended operation of the latch release by foreign objects.

An object of the present invention is a protective device for a latch release actuator of a vehicle seat belt. The protective device comprises a shield having an aperture. The shield is attachable to a latch body such that the shield substantially surrounds the latch release actuator aperture is situated proximate the latch release actuator so as to deter unintended actuation of the latch release actuator.

Another object of the present invention is a protective device for a latch release actuator of a vehicle seat belt. The protective device comprises a shield having a mounting portion with a fastener opening and a pair of arms extending from the mounting portion, at least one arm further including a raised portion. The shield is attachable to a latch body having a tab such that the arms engage the tab. The shield and tab cooperate to substantially surround the latch release actuator so as to deter unintended actuation of the latch release actuator.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
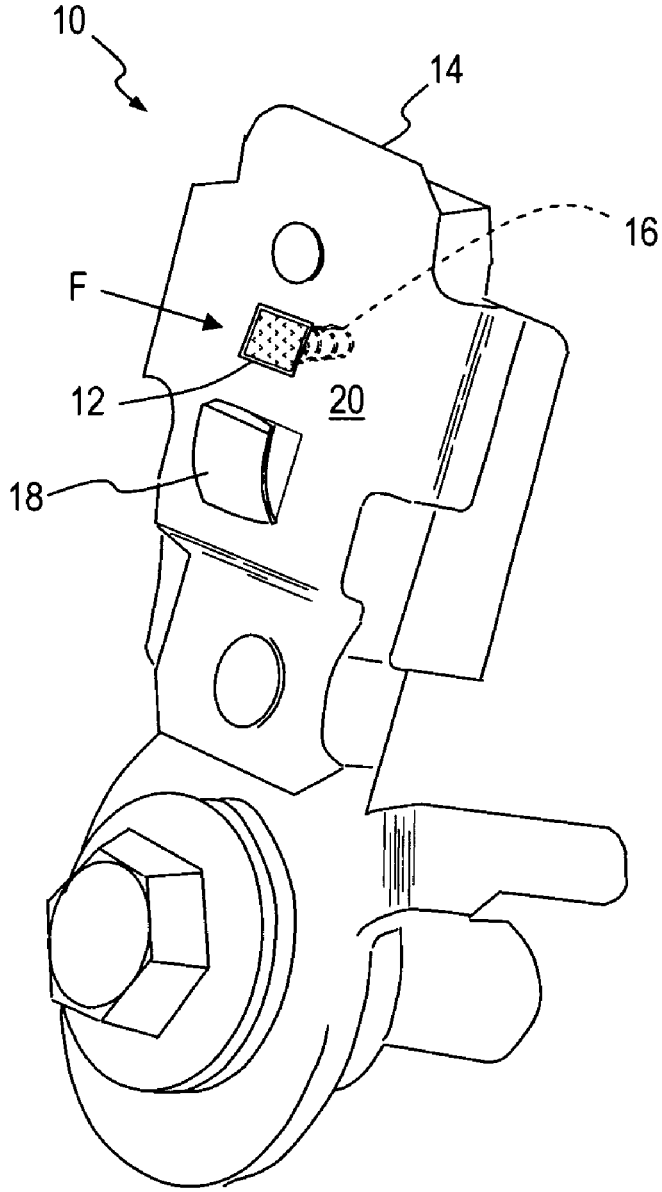
PRIOR ART Fig. 1
FIG. 1 is an isometric view of a portion of a latch release for a vehicle safety restraint system.

In the discussion to follow, like reference numerals designate like elements appearing in the several views. It should be noted that the present invention is directed to an actuator for a seat belt release mechanism and is equally applicable to the various types of seat belt latches and release mechanisms now known and hereafter invented. Accordingly, details of seat belt latches and release mechanisms will not be provided herein, except as applicable to explain the present invention.

With reference to FIG. 1, the relevant operational portion of a conventional seat belt latch release mechanism 10 is shown. Latch release mechanism 10 includes a push-type actuator 12 generally surrounded by and extending above a latch body 14. Actuator 12 is biased by a resilient member such as a spring 16 to prevent the latch release mechanism 10 from operating until affirmatively actuated. Depending upon the design of the safety restraint, an occupant of the vehicle either depresses a button or moves a lever (not shown for clarity) to apply a force "F" against actuator 12 to overcome the bias of spring 16, causing latch release mechanism 10 to operate and thereby allow the buckle and lock plate of the vehicle restraint system to disengage.

Latch body 14 may include a tab 18 that extends away from a face portion 20 of the latch body. Tab 18 is configured to resist unintended actuation of actuator 12 by obstructing foreign objects moving across face portion 20. However, as can be seen from FIG. 1, tab 18 provides protection for actuator 12 over only a limited area of face portion 20. Accordingly, under certain conditions it is possible for a foreign object to avoid tab 18 and forcibly engage actuator 12, thereby causing unintended operation of latch release mechanism 10 and allowing the belts of the vehicle restraint system to disengage.

Figure 2:
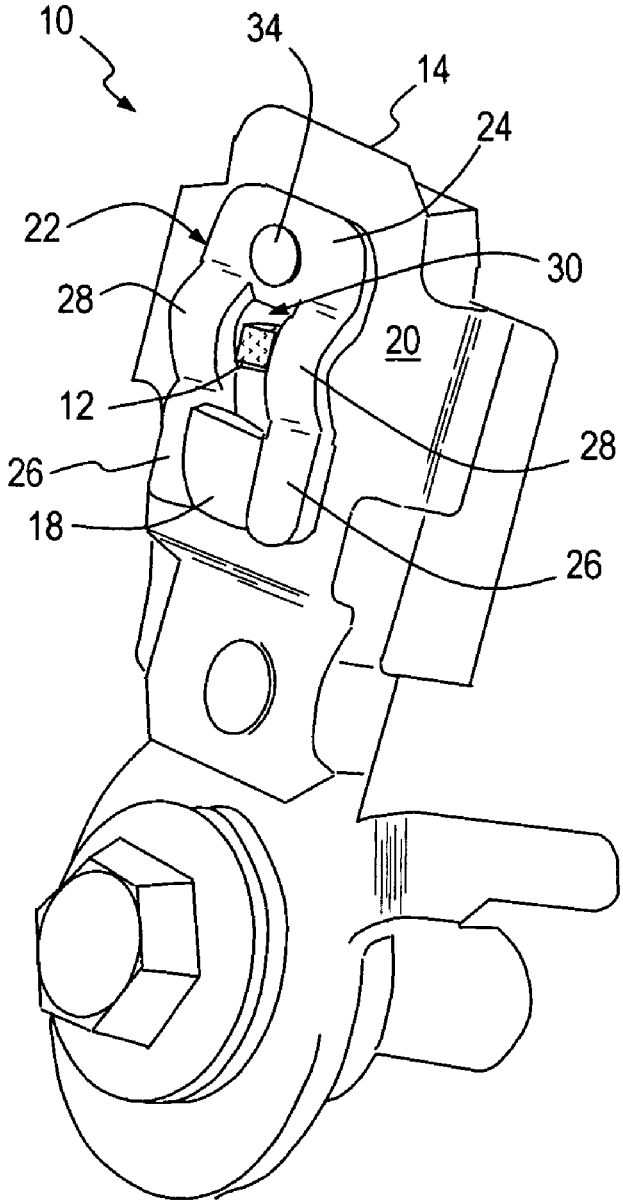
FIG. 2 depicts the latch release of FIG. 1, incorporating a protective device according to an embodiment of the present invention.
Figure 3A:
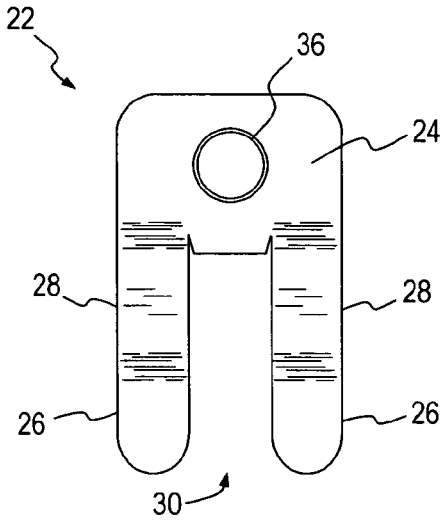
FIG. 3A shows a top plan view of a shield according to an embodiment of the present invention.
Figure 3B:
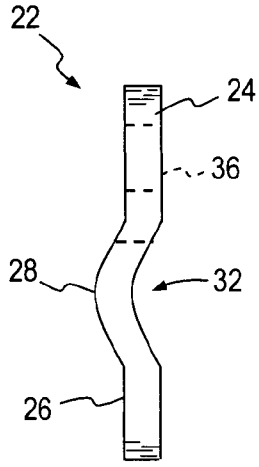
FIG. 3B shows a side elevational view of the shield of FIG. 3A.

A protective device for a vehicle seat belt latch release is shown in FIGS. 2, 3A and 3B. The protective device comprises a shield 22 having a mounting portion 24 and a pair of arms 26 extending generally perpendicularly therefrom, at least one arm having a raised portion 28. Mounting portion 24 and arms 26 form an aperture 30 that, in cooperation with tab 18, generally surrounds and extends above actuator 12 to deter actuation of the actuator by a foreign object. Mounting portion 24 forms a first sidewall, tab 18 forms a second, opposing sidewall and the arms 26 extend generally perpendicularly between the mounting portion and the tab to form third and fourth opposing sidewalls.

Raised portions 28 are generally arch-shaped and extend away from face portion 20. Raised portions 28 are further preferably shaped to minimize the amount of open area 32 under the arches to obstruct foreign objects from moving slidably underneath and engaging actuator 12. In other embodiments of the present invention open area 32 may be closed off.

As shown in FIG. 2, shield 22 is attached to latch body 14 in any conventional manner, such as with a fastener 34, which may be a rivet or screw driven through a fastener opening 36 in mounting portion 24 and into the latch body. In alternate embodiments shield 22 may be attached to latch body 14 with adhesives or welding or may be formed as a portion of the latch body by molding, stamping or machining or other suitable means. Shield 22 is oriented with latch body 14 such that arms 26 extend from mounting portion 24 and straddlingly engage tab 18 proximate distal ends of the arms and between the arms. Tab 18 thus cooperates with arms 26 to prevent rotation of shield 22 about fastener 34. Tab 18 additionally cooperates with shield 22 to protect actuator 12.

Figure 4A:
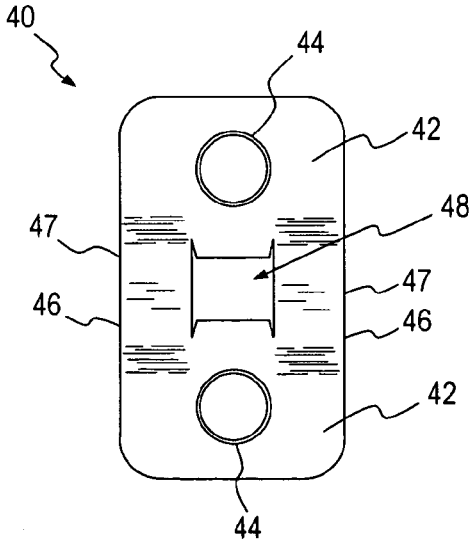
FIG. 4A shows a top plan view of a shield according to another embodiment of the present invention.
Figure 4B:
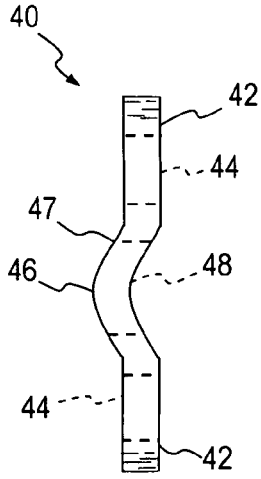
FIG. 4B shows a side elevational view of the shield of FIG. 4A.
Figure 5:
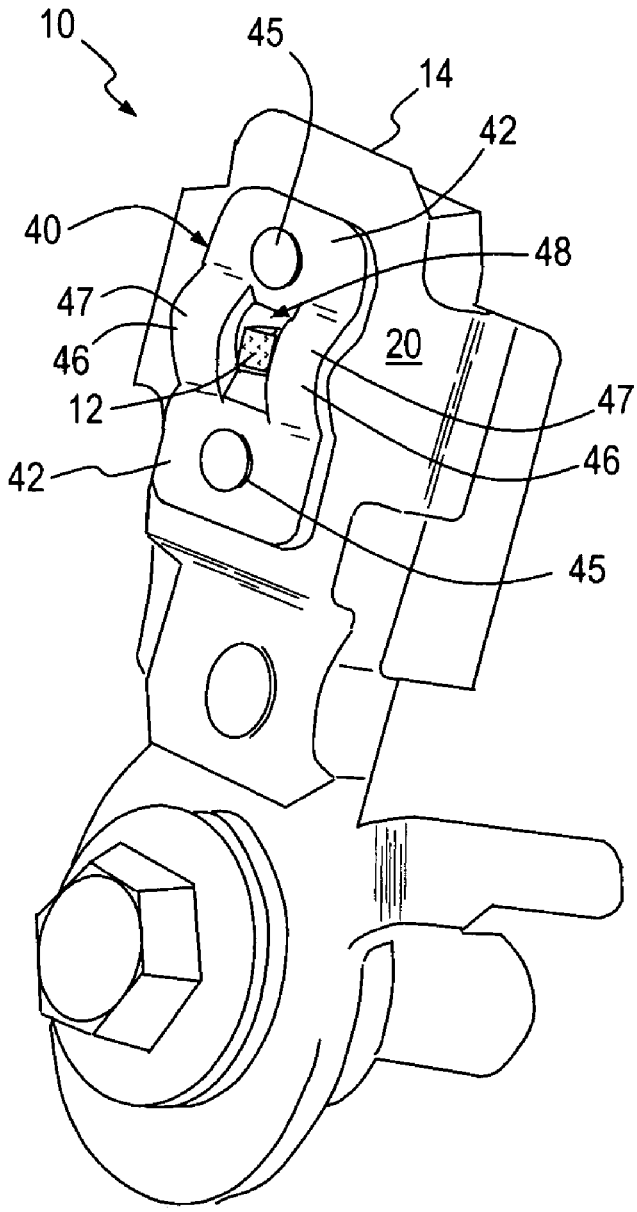
FIG. 5 is an isometric view of the shield of FIGS. 4A and 4B attached to a portion of a latch release for a vehicle safety restraint system.

In an alternate embodiment of the present invention a shield 40, shown in FIGS. 4A, 4B and 5, may include a plurality of mounting portions 42, at least one mounting portion having a fastener opening 44 to facilitate attachment of the shield to latch body 14 with a fastener 45. In alternate embodiments shield 40 may be attached to latch body 14 with adhesives or welding, or may be formed as a portion of the latch body by molding, stamping or machining. Shield 40 further includes a pair of arms 46 extending generally perpendicularly between mounting portions 42, at least one arm having a raised portion 47. Raised portions 47 may be shaped similar to raised portions 28 of shield 22 and thus will not be reiterated here. An aperture 48 formed by the arms 46 and the mounting portions 42 generally surrounds and extends above actuator 12 to resist actuation of the actuator if a foreign object forcibly engages the actuator. Shield 40 attaches to latch body 14 such that the shield substantially surrounds latch release actuator 12 to deter unintended actuation of the latch release actuator, mounting portions 42 forming first and second opposing sidewalls and arms 46 extending generally perpendicularly between the mounting portions to form third and fourth opposing sidewalls.

Figure 6A:
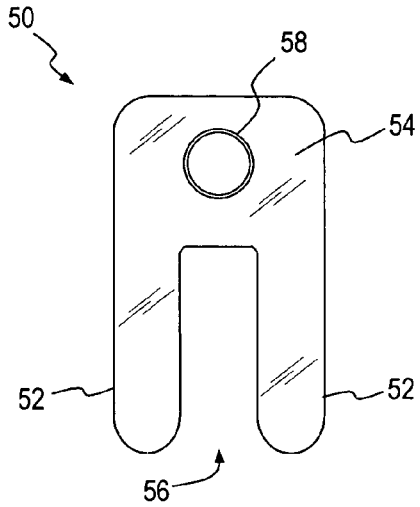
FIG. 6A shows a top plan view of a shield according to yet another embodiment of the present invention.
Figure 6B:
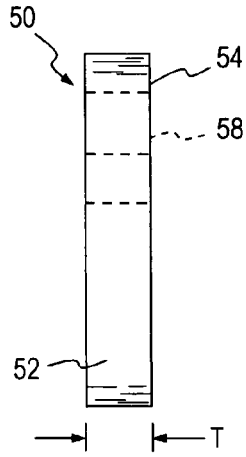
FIG. 6B shows a side elevational view of the shield of FIG. 6A.
Figure 8A:
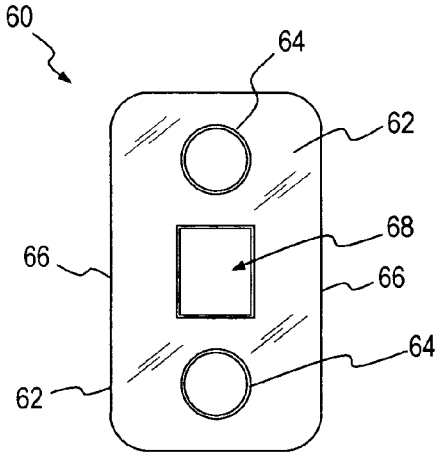
FIG. 8A shows a top plan view of a shield according to yet another embodiment of the present invention.
Figure 8B:
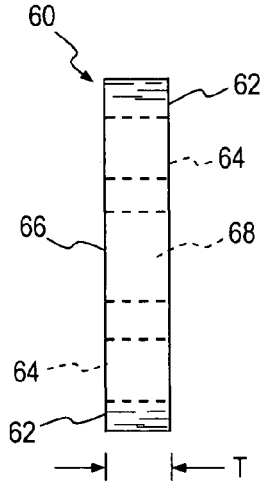
FIG. 8B shows a side elevational view of the shield of FIG. 8A.
Figure 7:
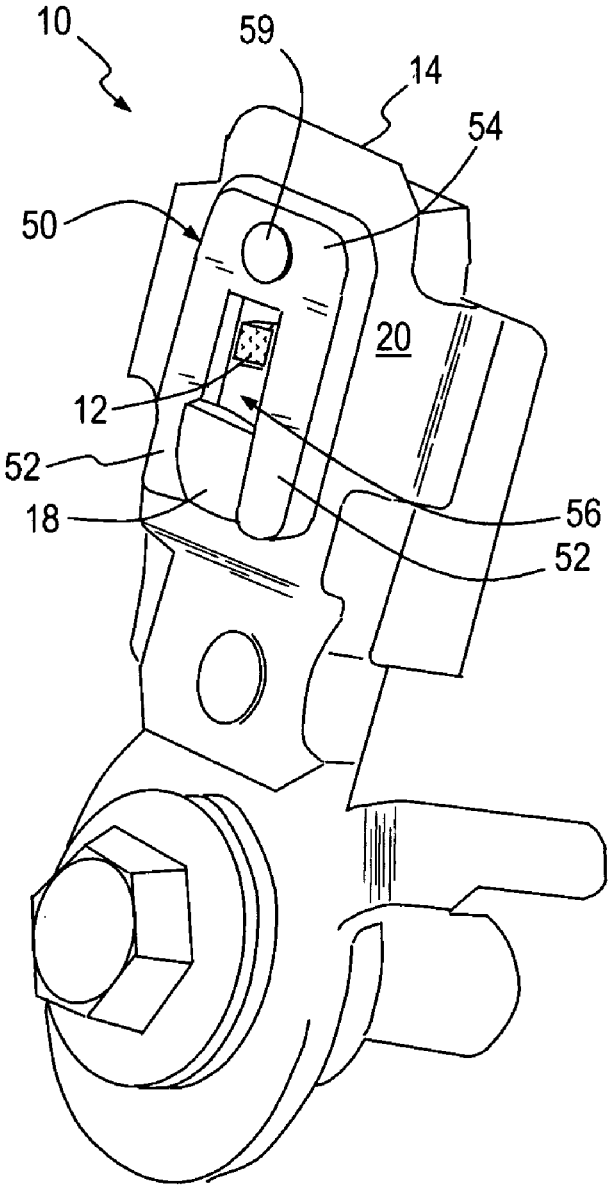
FIG. 7 is an isometric view of the shield of FIGS. 6A and 6B attached to a portion of a latch release for a vehicle safety restraint system.
Figure 9:
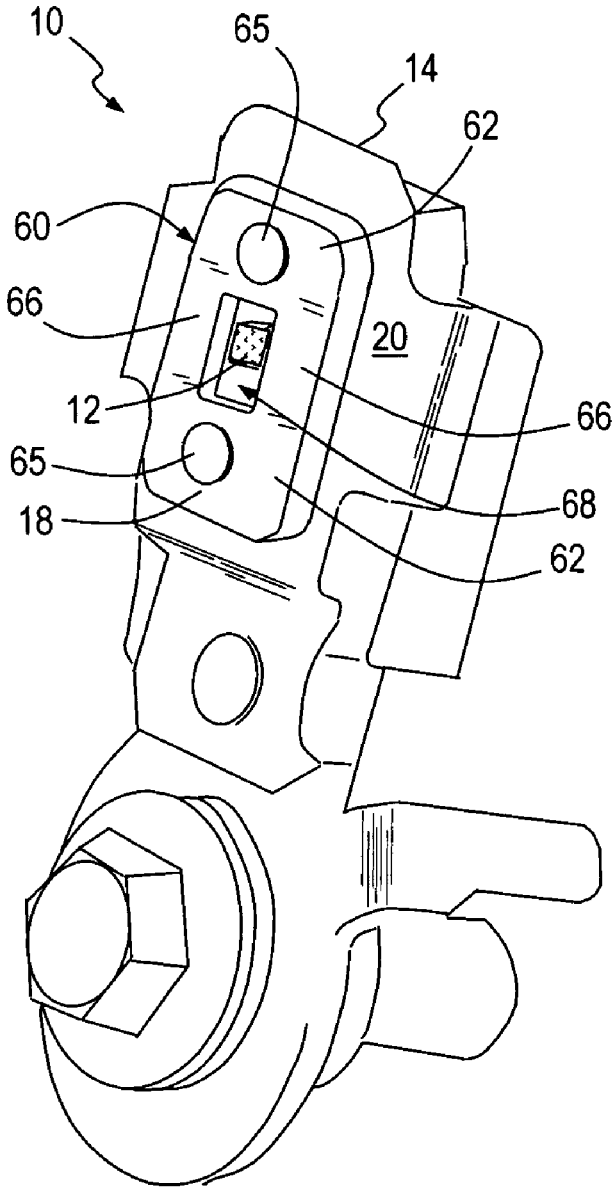
FIG. 9 is an isometric view of the shield of FIGS. 8A and 8B attached to a portion of a latch release for a vehicle safety restraint system.

In yet another alternate embodiment of the present invention a shield 50, shown in FIGS. 6A, 6B and 7, may not have raised portions, but rather a pair of arms 52 and a mounting portion 54 of sufficient thickness "T" to provide a barrier to protect actuator 12 from engagement by foreign objects. Arms 52 extend generally perpendicularly from mounting portion 54, the arms and mounting portion forming an aperture 56 that surrounds actuator 12. Mounting portion 54 may include a fastener opening 58 to facilitate attachment of the shield to latch body 14 with a fastener 59. In alternate embodiments shield 50 may be attached to latch body 14 with adhesives or welding, or may be formed as a portion of the latch body by molding, stamping or machining. Shield 50 is oriented with latch body 14 such that arms 52 extend from mounting portion 54 and engage tab 18. Tab 18 thus cooperates with arms 52 to prevent rotation of shield 50 about fastener 59. Tab 18 additionally cooperates with shield 50 to protect actuator 12. Mounting portion 54 forms a first sidewall, tab 18 forms a second, opposing sidewall and arms 52 extend generally perpendicularly between the mounting portion and the tab to form third and fourth opposing sidewalls In still another embodiment of the present invention a shield 60, shown in FIGS. 8A, 8B and 9, has a plurality of mounting portions 62, at least one mounting portion having a fastener opening 64 to facilitate attachment of the shield to a latch body 14 with a fastener 65. In alternate embodiments shield 60 may be attached to latch body 14 with adhesives or welding, or may be formed as a portion of the latch body by molding, stamping or machining. A pair of arms 66 extend generally perpendicularly between mounting portions 62. An aperture 68 formed by arms 66 and mounting portions 62 substantially surrounds actuator 12. Shield 60 is of sufficient thickness "T" to extend above actuator 12 to deter actuation of the actuator if a foreign object forcibly engages the actuator. Shield 60 attaches to latch body 14 such that the shield substantially surrounds latch release actuator 12, mounting portions 62 forming first and second opposing sidewalls and arms 66 extending generally perpendicularly between the mounting portions to form third and fourth opposing sidewalls.

Shields 22, 40, 50, 60 may be made from any suitable material compatible with latch mechanism 10 and the expected environment. Example materials include, but are not limited to, metals such as steel and aluminum, plastics, and composites. Likewise, shields 22, 40, 50, 60 may be finished by painting, plating and coating.

While this invention has been shown and described with respect to a detailed embodiment thereof, it will be understood by those skilled in the art that changes in form and detail thereof may be made without departing from the scope of the claims of the invention.

What is claimed is:

1. A protective device for a latch release actuator of a vehicle seat belt, comprising:

a latch body having a single stationary tab; and a shield having a single mounting portion and a pair of spaced-apart arms extending from the mounting portion, wherein the shield attaches to the latch body such that the tab is disposed between the arms, and wherein the tab cooperates with the shield to substantially surround the latch release actuator to deter unintended actuation of the latch release actuator, the mounting portion forming a first sidewall, the tab forming a second, opposing sidewall and the arms extending generally perpendicularly between the mounting portion and the tab to form third and fourth opposing sidewalls.

2. The protective device of claim 1 wherein at least one arm further includes a raised portion.

3. The protective device of claim 1 wherein the mounting portion further comprises a fastener opening.

4. The protective device of claim 3 wherein the mounting portion is adapted to be attachable to the latch body with a fastener in cooperation with the fastener opening.

5. The protective device of claim 4 wherein the fastener is a rivet.

6. A protective device for a latch release actuator of a vehicle seat belt, comprising:

a latch body having a single stationary tab; and a shield, comprising:

a single mounting portion having a fastener opening, and a pair of spaced-apart arms extending from the mounting portion, at least one arm further including a raised portion, wherein the shield attaches to the latch body such that the tab is disposed between the arms proximate distal ends of the arms, and wherein the tab cooperates with the shield to substantially surround the latch release actuator to deter unintended actuation of the latch release actuator, the mounting portion forming a first sidewall, the tab forming a second, opposing sidewall and the arms extending generally perpendicularly between the mounting portion and the tab to form third and fourth opposing sidewalls.

7. A protective device for a latch release actuator of a vehicle seat belt, comprising:

a latch body; and a shield, comprising:

two mounting portions, and a pair of spaced-apart arms extending between the mounting portions, wherein the shield attaches to the latch body such that the shield substantially surrounds the latch release actuator to deter unintended actuation of the latch release actuator, the mounting portions forming first and second opposing sidewalls and the arms extending generally perpendicularly between the mounting portions to form third and fourth opposing sidewalls.

8. The protective device of claim 7 wherein at least one arm further includes a raised portion.

9. The protective device of claim 7 wherein at least one mounting portion further comprises a fastener opening.

10. The protective device of claim 9 wherein at least one mounting portion is adapted to be attachable to the latch body with a fastener in cooperation with the fastener openings.

11. A protective device for a latch release actuator of a vehicle seat belt, comprising:

a latch body having a single stationary tab; and a shield having a single mounting portion and a pair of spaced-apart arms extending from the mounting portion, wherein the shield attaches to the latch body such that the tab is disposed between the arms and positioned proximate distal ends of the arms, wherein the tab cooperates with the shield to substantially surround the latch release actuator, the mounting portion forming a first sidewall, the tab forming a second, opposing sidewall and the arms extending generally perpendicularly between the mounting portion and the tab to form third and fourth opposing sidewalls, and wherein the shield is of sufficient thickness to extend away from the latch body by a greater dimension than the latch release actuator so as to deter unintended actuation of the latch release actuator.

12. The protective device of claim 11 wherein the mounting portion further comprises a fastener opening.

13. The protective device of claim 12 wherein the mounting portion is adapted to be attachable to the latch body with a fastener in cooperation with the fastener opening.

14. A protective device for a latch release actuator of a vehicle seat belt, comprising:

a latch body; and an integral shield, comprising:

two mounting portions, and a pair of spaced-apart arms extending between the mounting portions, wherein the shield attaches to the latch body such that the shield substantially surrounds the latch release actuator, the mounting portions forming first and second opposing sidewalls and the arms extending generally perpendicularly between the mounting portions to form third and fourth opposing sidewalls, and wherein the shield is of sufficient thickness to extend away from the latch body by a greater dimension than the latch release actuator to deter unintended actuation of the latch release actuator.

15. The protective device of claim 14 wherein at least one mounting portion further comprises a fastener opening.

16. The protective device of claim 14 wherein at least one mounting portion is adapted to be attachable to the latch body with a fastener in cooperation with the fastener opening.

* * * * *